US006507325B2

(12) United States Patent
Matz et al.

(10) Patent No.: US 6,507,325 B2
(45) Date of Patent: Jan. 14, 2003

(54) ANTENNA ALIGNMENT CONFIGURATION

(75) Inventors: William R. Matz, Atlanta, GA (US); Timothy H. Weaver, Alpharetta, GA (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 09/751,276

(22) Filed: Dec. 29, 2000

(65) Prior Publication Data

US 2002/0084944 A1 Jul. 4, 2002

(51) Int. Cl.[7] ..... H01Q 1/38

(52) U.S. Cl. ..... 343/878; 343/755; 343/765; 343/880; 343/892; 342/359

(58) Field of Search ..... 343/755, 757, 343/765, 880, 882, 878, 890, 892; 248/218.4, 652; 342/77, 359

(56) References Cited

U.S. PATENT DOCUMENTS

| | | | | |
|---|---|---|---|---|
| 4,095,230 A | | 6/1978 | Salmond et al. | |
| 4,126,865 A | | 11/1978 | Longhurst et al. | |
| 4,237,465 A | | 12/1980 | Shibano et al. | |
| 4,495,706 A | | 1/1985 | Kaminski | |
| 4,626,864 A | | 12/1986 | Micklethwaite | |
| 4,691,207 A | | 9/1987 | Timineri | |
| 4,726,259 A | | 2/1988 | Idler | |
| 4,833,932 A | | 5/1989 | Rogers | |
| 4,990,924 A | | 2/1991 | McMullen et al. | |
| 5,276,972 A | | 1/1994 | Staney | |
| 5,351,060 A | | 9/1994 | Bayne | |
| 5,463,403 A | | 10/1995 | Walker et al. | |
| 5,469,182 A | | 11/1995 | Chaffee | |
| 5,473,335 A | | 12/1995 | Tines | |
| 5,561,433 A | | 10/1996 | Chaney et al. | |
| 5,589,837 A | | 12/1996 | Soleimani et al. | |
| 5,646,638 A | * | 7/1997 | Winegard et al. | 343/882 |
| 5,647,134 A | | 7/1997 | Chou | |
| 5,657,031 A | * | 8/1997 | Anderson et al. | 343/757 |
| 5,734,356 A | * | 3/1998 | Chang | 343/882 |
| 5,760,739 A | | 6/1998 | Pauli | |
| 5,829,121 A | | 11/1998 | Shoemaker et al. | |
| 5,870,059 A | * | 2/1999 | Reynolds | 343/760 |
| 5,894,674 A | | 4/1999 | Feldman | |
| 5,903,237 A | | 5/1999 | Crosby et al. | |
| 5,923,288 A | | 7/1999 | Pedlow, Jr. | |
| 5,933,123 A | | 8/1999 | Kaul | |
| 5,940,028 A | | 8/1999 | Iwamura | |
| 5,945,945 A | | 8/1999 | Wagner et al. | |
| D413,603 S | | 9/1999 | Inoue | |
| 5,977,922 A | | 11/1999 | Hemmingsen, II | |
| 5,999,139 A | * | 12/1999 | Benjamin et al. | 343/765 |
| 6,023,247 A | | 2/2000 | Rodeffer | |
| 6,031,508 A | | 2/2000 | Ishizuka et al. | |
| 6,037,913 A | | 3/2000 | Johnson | |
| 6,208,314 B1 | | 3/2001 | Bourquin | |
| 6,229,480 B1 | | 5/2001 | Shintani | |
| 6,262,687 B1 | | 7/2001 | Bai et al. | |
| 6,285,338 B1 | | 9/2001 | Bai et al. | |
| 6,331,839 B1 | | 12/2001 | Grenell | |
| 6,188,372 B1 | * | 2/2002 | Jackson et al. | 343/882 |

OTHER PUBLICATIONS

Photograph of antenna and mounting bracket, manufactured by Channel Master Company and believed to have been publicly available more than one year prior to the filing date of the subject application.

* cited by examiner

*Primary Examiner*—Tho Phan
(74) *Attorney, Agent, or Firm*—Kirkpatrick & Lockhart LLP

(57) ABSTRACT

An antenna that has an alignment configuration for aligning the antenna with a satellite. In one embodiment, the antenna includes an antenna reflector that has a centerline and a front surface and a rear surface. A reference plane is defined on the rear surface that is perpendicular to the centerline of the reflector. The reference plane is used in connection with alignment devices for orienting the antenna reflector in desired azimuth, elevation, and skew orientations.

44 Claims, 9 Drawing Sheets

ANTENNA ALIGNMENT CONFIGURATION

CROSS-REFERENCE TO RELATED APPLICATIONS

Not applicable.

FEDERALLY SPONSORED RESEARCH

Not applicable.

BACKGROUND OF THE INVENTION

1. Field of the Invention

The subject invention relates to antennas and alignment devices therefor.

2. Description of the Invention Background

The advent of the television can be traced as far back to the end of the nineteenth century and beginning of the twentieth century. However, it wasn't until 1923 and 1924, when Vladimir Kosma Zworykin invented the iconoscope, a device that permitted pictures to be electronically broken down into hundreds of thousands of components for transmission, and the kinescope, a television signal receiver, did the concept of television become a reality. Zworykin continued to improve those early inventions and television was reportedly first showcased to the world at the 1939 World's Fair in New York, where regular broadcasting began.

Over the years, many improvements to televisions and devices and methods for transmitting and receiving television signals have been made. In the early days of television, signals were transmitted via terrestrial radio networks and received through the use of antennas. Signal strength and quality, however, were often dependent upon the geography of the land between the transmitting antenna and the receiving antenna. Although such transmission methods are still in use today, the use of satellites to transmit television signals is becoming more prevalent. Because satellite transmitted signals are not hampered by hills, trees, mountains, etc., such signals typically offer the viewer more viewing options and improved picture quality. Thus, many companies have found offering satellite television services to be very profitable and, therefore, it is anticipated that more and more satellites will be placed in orbit in the years to come. As additional satellites are added, more precise antenna/satellite alignment methods and apparatuses will be required.

Modern digital satellite communication systems typically employ a ground-based transmitter that beams an uplink signal to a satellite positioned in geosynchronous orbit. The satellite relays the signal back to ground-based receivers. Such systems permit the household or business subscribing to the system to receive audio, data and video signals directly from the satellite by means of a relatively small directional receiver antenna. Such antennas are commonly affixed to the roof or wall of the subscriber's residence or are mounted to a tree or mast located in the subscriber's yard. A typical antenna constructed to received satellite signals comprises a dish-shaped reflector that has a support arm protruding outward from the front surface of the reflector. The support arm supports a low noise block amplifier with an integrated feed "LNBF". The reflector collects and focuses the satellite signal onto the LNBF which is connected, via cable, to the subscriber's television.

To obtain an optimum signal, the antenna must be installed such that the centerline axis of the reflector, also known as the "bore site" or "pointing axis", is accurately aligned with the satellite. To align an antenna with a particular satellite, the installer must be provided with accurate positioning information for that particular satellite. For example, the installer must know the proper azimuth and elevation settings for the antenna. The azimuth setting is the compass direction that the antenna should be pointed relative to magnetic north. The elevation setting is the angle between the Earth and the satellite above the horizon. Many companies provide installers with alignment information that is specific to the geographical area in which the antenna is to be installed. Also, as the satellite orbits the earth, it may be so oriented such that it sends a signal that is somewhat skewed. To obtain an optimum signal, the antenna must also be adjustable to compensate for a skewed satellite orientation.

The ability to quickly and accurately align the centerline axis of antenna with a satellite is somewhat dependent upon the type of mounting arrangement employed to support the antenna. Prior antenna mounting arrangements typically comprise a mounting bracket that is directly affixed to the rear surface of the reflector. The mounting bracket is then attached to a vertically oriented mast that is buried in the earth, mounted to a tree, or mounted to a portion of the subscriber's residence or place of business. The mast is installed such that it is plumb (i.e., relatively perpendicular to the horizon). Thereafter, the installer must orient the antenna to the proper azimuth and elevation. These adjustments are made at the mounting bracket.

One method that has been employed in the past for indicating when the antenna has been positioned at a proper azimuth orientation is the use of a compass that is manually supported by the installer under the antenna's support arm. When using this approach however, the installer often has difficulty elevating the reflector to the proper elevation so that the antenna will be properly aligned and then retaining the antenna in that position while the appropriate bolts and screws have been tightened. The device disclosed in U.S. Pat. No. 5,977,922 purports to solve that problem by affixing a device to the support arm that includes a compass and an inclinometer. In this device, the support arm can move slightly relative to the reflector and any such movement or misalignment can contribute to pointing error. Furthermore, devices that are affixed to the support arm are not as easily visible to the installer during the pointing process. In addition, there are many different types and shapes of support arms which can require several different adapters to be available to the installer. It will also be understood that the use of intermediate adapters could contribute pointing error if they do not interface properly with the support arm.

Another method that has been used in the past to align the antenna with a satellite involves the use of a "set top" box that is placed on or adjacent to the television to which the antenna is attached. A cable is connected between the set top box and the antenna. The installer initially points the antenna in the general direction of the satellite, then fine-tunes the alignment by using a signal strength meter displayed on the television screen by the set top box. The antenna is adjusted until the onscreen meter indicates that signal strength and quality have been maximized. In addition to the onscreen display meter, many set top boxes emit a repeating tone. As the quality of the signal improves, the frequency of the tones increases. Because the antenna is located outside of the building in which the television is located, such installation method typically requires two individuals to properly align the antenna. One installer positions the antenna while the other installer monitors the onscreen meter and the emitted tones. One individual can also employ this method, but that person typically must make multiple trips between the antenna and the television until the antenna is properly positioned. Thus, such alignment methods are costly and time consuming.

In an effort to improve upon this shortcoming, some satellite antennas have been provided with a light emitting diode ("LED") that operates from feedback signals fed to the antenna by the set top box through the link cable. The LED flashes to inform the installer that the antenna has been properly positioned. It has been noted, however, that the user is often unable to discern small changes in the flash rate of the LED as antenna is positioned. Thus, such approach may result in antenna being positioned in a orientation that results in less than optimum signal quality. Also, this approach only works when the antenna is relative close to its correct position. It cannot be effectively used to initially position the antenna. U.S. Pat. No. 5,903,237 discloses a microprocessor-operated antenna pointing aid that purports to solve the problems associated with using an LED indicator to properly orient the antenna.

Such prior antenna mounting devices and methods do not offer a relatively high amount of alignment precision. As additional satellites are sent into space, the precision at which an antenna is aligned with a particular satellite becomes more important to ensure that the antenna is receiving the proper satellite signal and that the quality of that signal has been optimized.

There is a need for an antenna that has an alignment configuration that can be successfully employed with alignment devices for providing an indication of the antenna's elevation, azimuth and skew orientations.

SUMMARY OF THE INVENTION

In accordance with one form of the present invention, there is provided an antenna that includes an antenna reflector that has a centerline and a front surface and a rear surface. The rear surface defines a reference plane that is substantially perpendicular to the centerline. The reference plane may be used in connection with various alignment devices such as compasses, levels and the like to orient the antenna in desired azimuth, elevation and/ or skew orientations.

In another embodiment, the present invention comprises an antenna reflector having a centerline and front and rear surfaces and three sockets molded into the rear surface to define a reference plane that is perpendicular to the centerline. The sockets may be employed to attach alignment devices such as compasses and levels to the reflector for alignment purposes. The sockets may be glued or otherwise attached to the rear surface of the antenna reflector, instead of being molded thereto, if so desired.

Another embodiment of the present invention comprises a method for aligning an antenna reflector having a centerline and front and rear surfaces with a satellite. The method may include establishing a reference plane on the antenna that is perpendicular to the centerline and orienting a compass such that it is perpendicular with respect to the centerline. The method further includes viewing the compass to ascertain the azimuth of the antenna and reorienting the antenna to a desired azimuth position, if necessary. The antenna is retained in the desired azimuth position. The method may further include orienting a level such that it is parallel to the centerline and thereafter viewing the level to ascertain the elevation of the antenna. The antenna may be reoriented to a desired elevation position, if necessary. The antenna may then be retained in the desired elevation position.

It is a feature of the present invention to provide an alignment configuration on an antenna that may be used in connection with a variety of different alignment apparatuses to orient the antenna in desired azimuth, elevation, and/or skew orientations.

Accordingly, the present invention provides solutions to the shortcomings of prior apparatuses and methods for orienting antennas for receiving satellite signals. Those of ordinary skill in the art will readily appreciate, however, that these and other details, features and advantages will become further apparent as the following detailed description of the embodiments proceeds.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE EMBODIMENTS OF THE INVENTION

Figure 1:
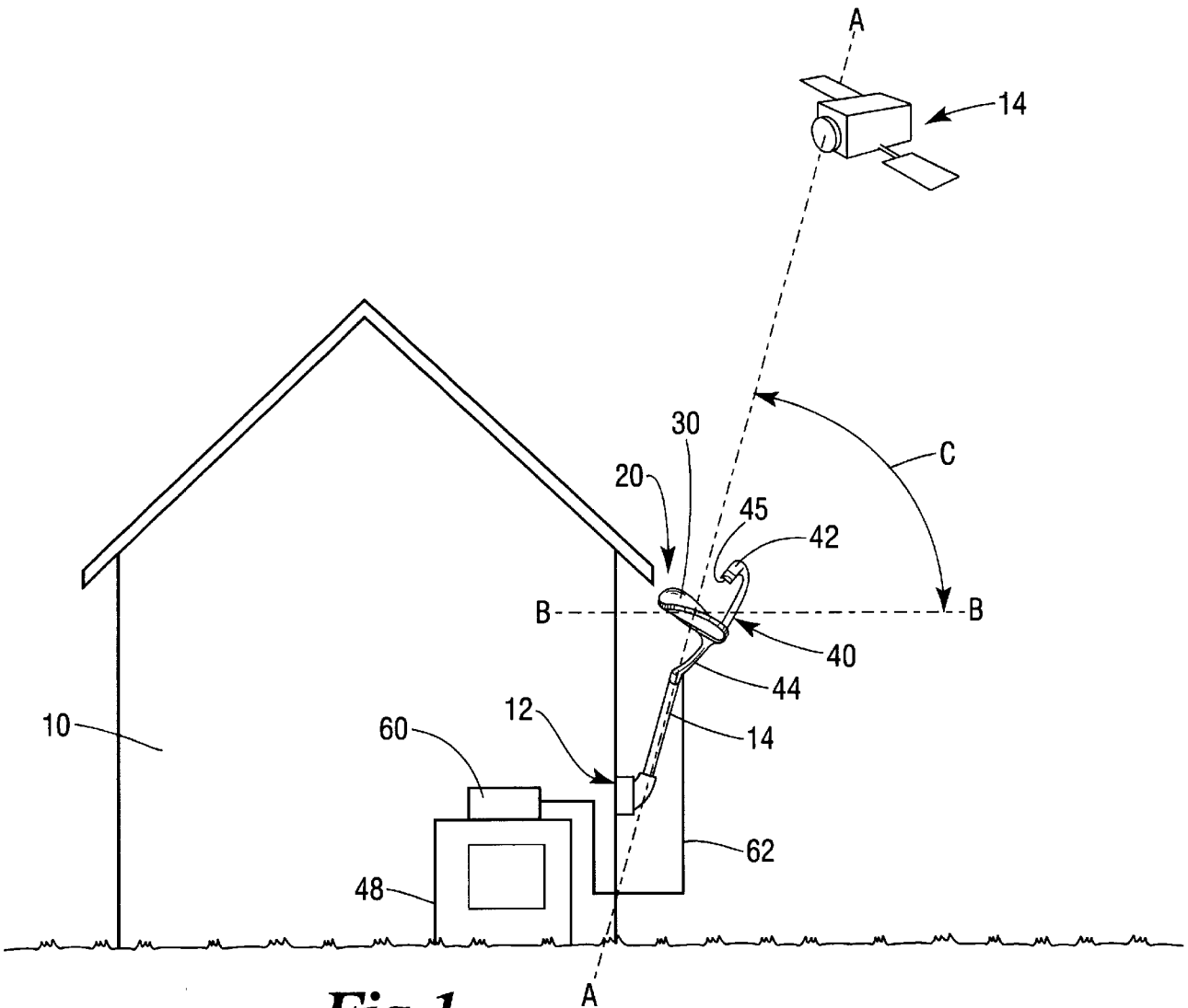
FIG. 1 is a graphical representation of an antenna attached to a building and aligned to receive a signal from a satellite.
Figure 3:
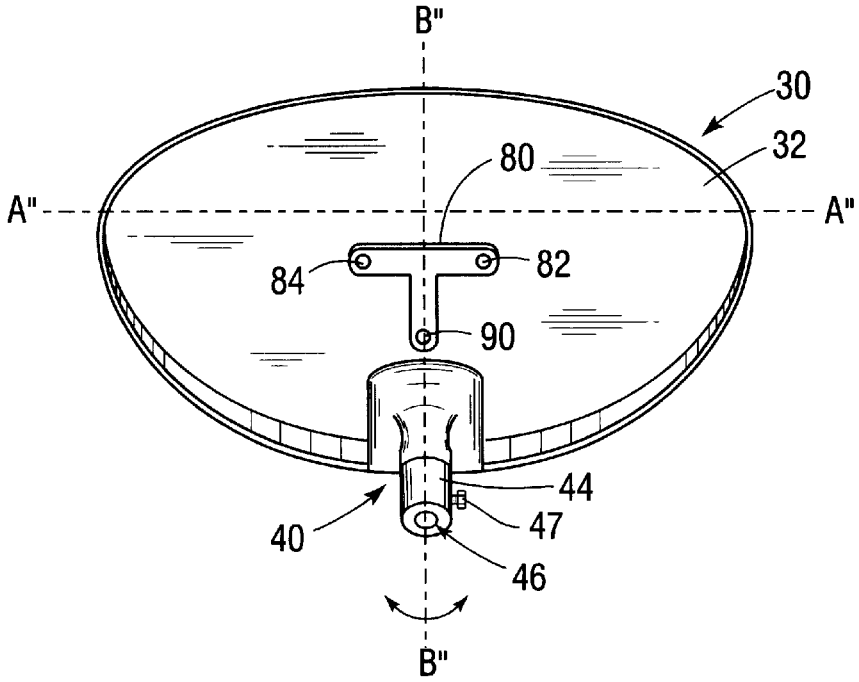
FIG. 3 is a rear view of the antenna depicted in FIG. 2.

Referring now to the drawings for the purposes of illustrating embodiments of the invention only and not for the purposes of limiting the same, FIG. 1 illustrates an antenna 20 that is attached to the wall of a residence or other building 10 by a mounting bracket 12. The antenna 20 is oriented to receive audio and video signals from a satellite 14 in geosynchronous orbit around the earth. The antenna 20 includes parabolic reflector 30 and an arm assembly 40 that includes a forwardly extending portion 42 that supports a feed/LNBF assembly 45 for collecting focused signals from the reflector 30. Such feed/LNBF assemblies are known in the art and, therefore, the manufacture and operation of feed/LNBF assembly 45 will not be discussed herein. The antenna 20 has a centerline generally designated as A—A and is connected to a mounting bracket 12 by means of a rearwardly extending portion 44 of the support arm 44. A socket 46 is provided in the rearwardly extending portion 44 for receiving an antenna mounting mast 14 therein. See FIG. 3. The mounting mast 14 is affixed to a mounting bracket 12 that is attached to a wall of the building 10. As can be seen in FIG. 1, in this antenna embodiment, the centerline axis A—A is coaxially aligned with the centerline of the mounting mast 14. Such arrangement permits the antenna 20 to be easily adjusted for satellite skew by rotating the antenna about the mast 14 until the desired skew orientation is achieved.

The antenna 20 is attached to a satellite broadcast receiver ("set top box") 60 by coaxial cable 62. The set top box 60 is attached to a television monitor 48. Such set top boxes are known in the art and comprise an integrated receiver decoder for decoding the received broadcast signals from the antenna 20. During operation, the feed/LNBF assembly 45 converts the focused signals from the satellite 14 to an electrical current that is amplified and down converted in frequency. The amplified and down-converted signals are then conveyed via cable 62 to the set top box 60. The set top box 60 tunes the output signal to a carrier signal within a predetermined frequency range. A tuner/demodulator within the set top box 60 decodes the signal carrier into a digital data stream selected signal. Also a video/audio decoder is provided within the set top box 60 to decode the encrypted video signal. A conventional user interface on the television screen is employed to assist the installer of the antenna 20 during the final alignment and "pointing" of the antenna 20.

Figure 1A:
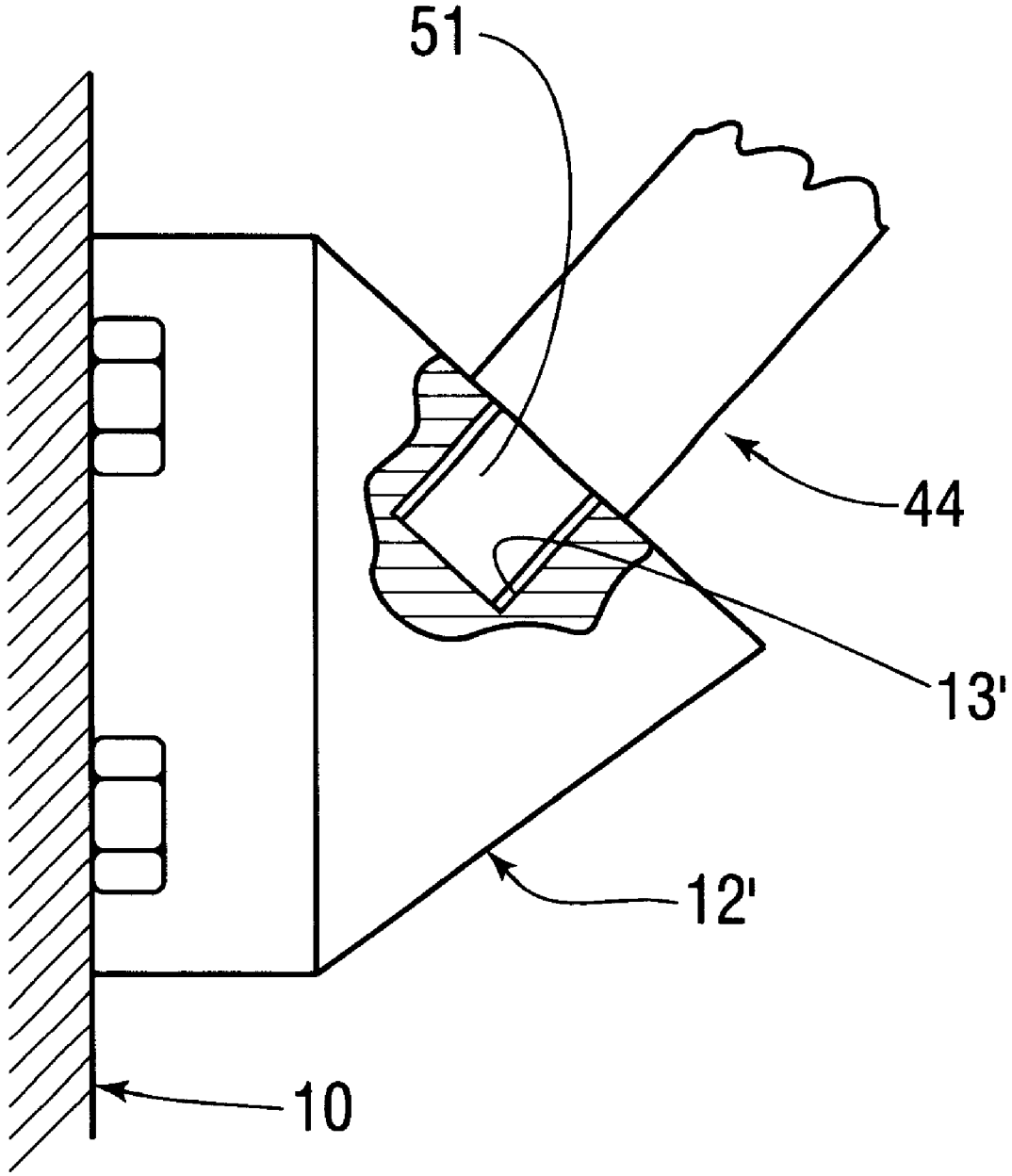
FIG. 1A is a partial view of an alternate antenna mounting member employed to support the support arm of an antenna.

In this embodiment, the mounting bracket 12 is attached to the wall of the building 10 or is affixed to a freestanding mast (not shown). The mounting bracket 12 has a mast 14 protruding therefrom that is sized to be received in a socket 46 in the mounting portion of the arm. As indicated above, the mounting bracket 12 may comprise the apparatus disclosed in copending U.S. patent application Ser. No. 09/751,460, entitled "Mounting Bracket", the disclosure of which is herein incorporated by reference. In another alternative mounting arrangement, the rearwardly extending portion of the support arm 44 may have a protrusion 51 formed thereon or attached thereto that is sized to be received and retained within a mounting bracket 12' that has a socket 13' formed therein. See FIG. 1A. However, other antenna mounting arrangements may be employed.

Figure 2:
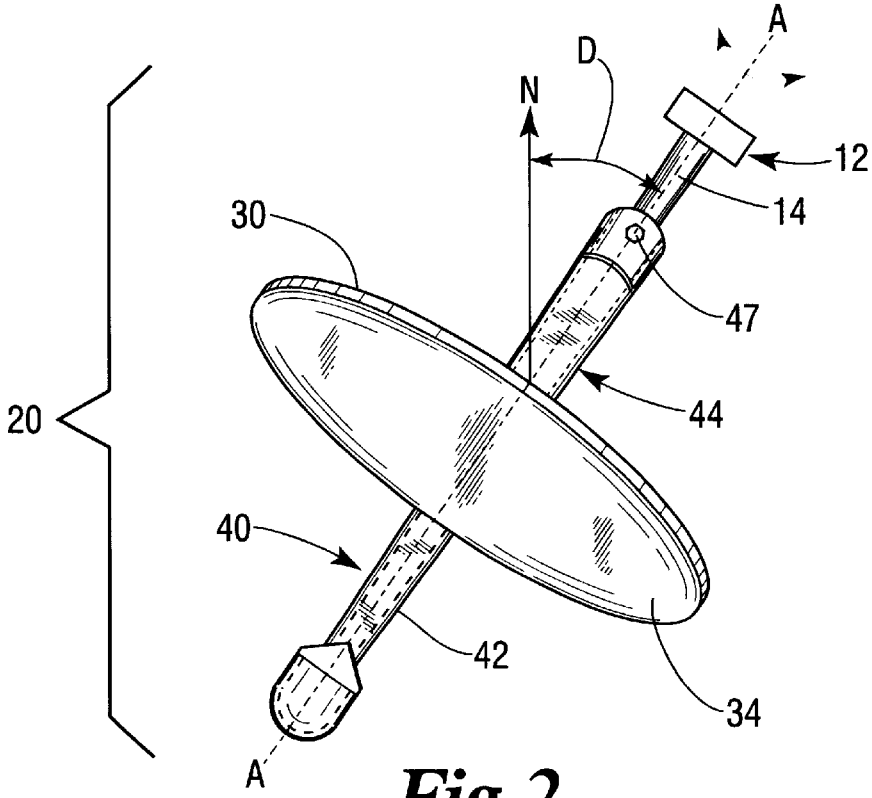
FIG. 2 is a plan view of an antenna attached to a mounting bracket.

Antenna 20 must be properly positioned to receive the television signals transmitted by the satellite 14 to provide optimal image and audible responses. This positioning process involves accurately aligning the antenna's centerline axis A—A, with the satellite's output signal. "Elevation", "azimuth" and "skew" adjustments are commonly required to accomplish this task. As shown in FIG. 1, elevation refers to the angle between the centerline axis A—A of the antenna relative to the horizon (represented by line B—B), generally designated as angle "C". In the antenna embodiment depicted in FIGS. 1 and 2, the elevation is adjusted by virtue of an elevation adjustment mechanism on the mounting bracket 12. In one mounting bracket embodiment disclosed in the above-mentioned patent application, the elevation is adjusted by loosening two elevation locking bolts and turning an elevation adjustment screw until the desired elevation has been achieved. The elevation locking bolts are then tightened to lock the bracket in position. As shown in FIG. 2, "azimuth" refers to the angle of axis A—A relative to the direction of true north in a horizontal plane. That angle is generally designated as angle "D" in FIG. 2. "Skew" refers to the angular orientation of the reflector antenna about the centerline or bore site.

Figure 4:
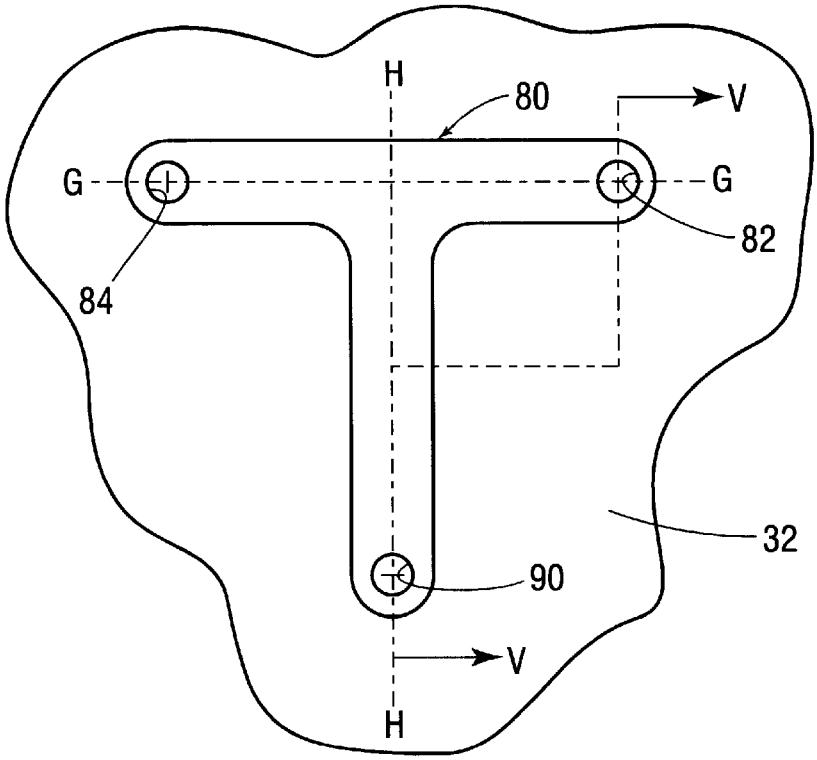
FIG. 4 is a partial view of the rear surface of the antenna depicted in FIGS. 2 and 3 illustrating the attachment portion of the present invention.
Figure 5:
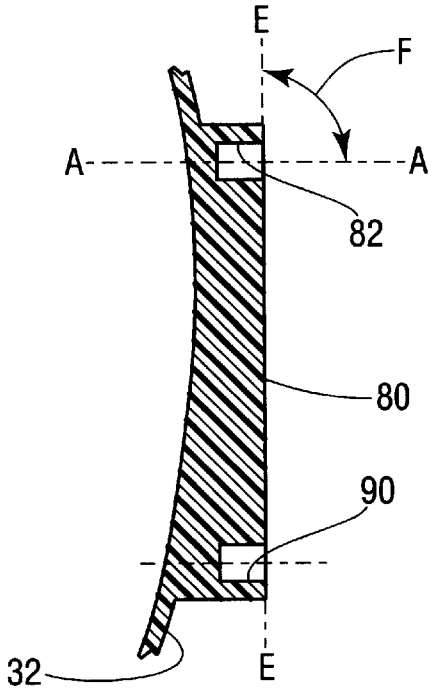
FIG. 5 is a partial cross-sectional view of the antenna of FIG. 4 taken along line V—V in FIG. 4.
Figure 4A:
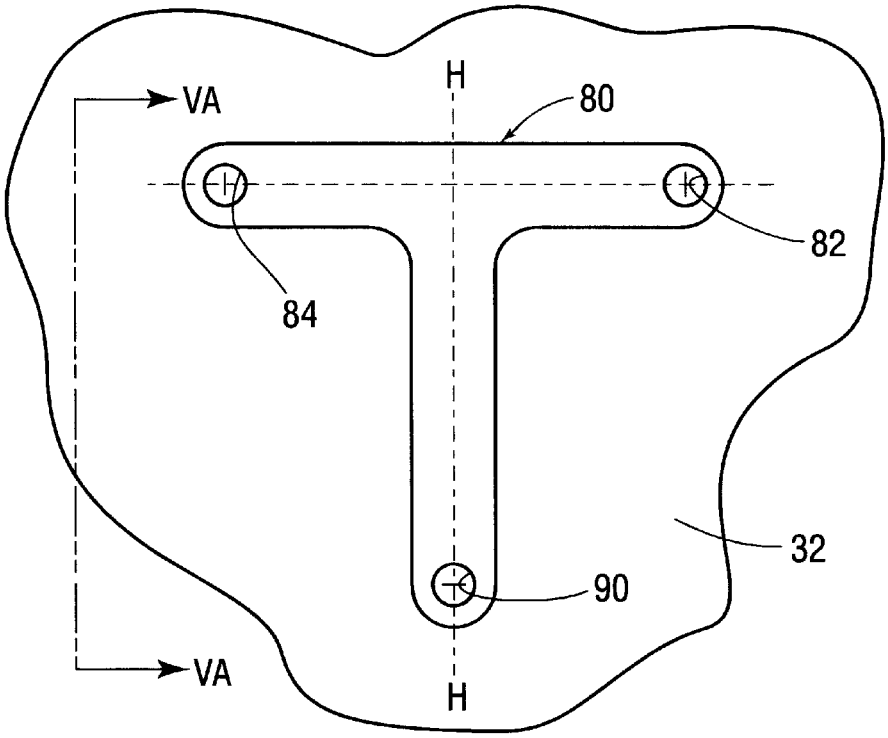
FIG. 4A is a partial view of the rear surface of another antenna illustrating another attachment portion of the present invention.
Figure 5A:
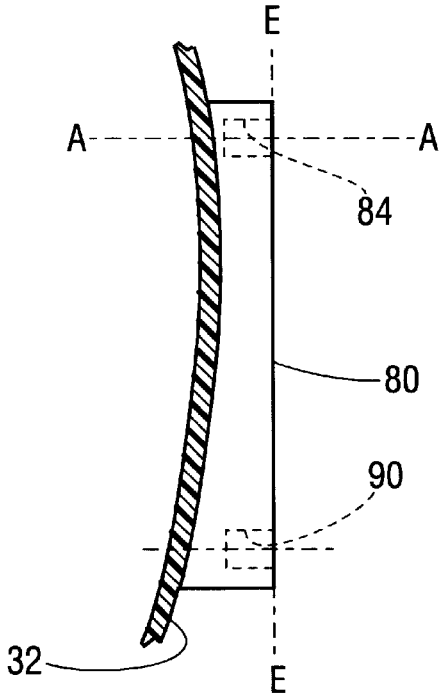
FIG. 5A is a partial cross-sectional view of the antenna of FIG. 4A taken along line VA—VA in FIG. 4A.
Figure 4B:
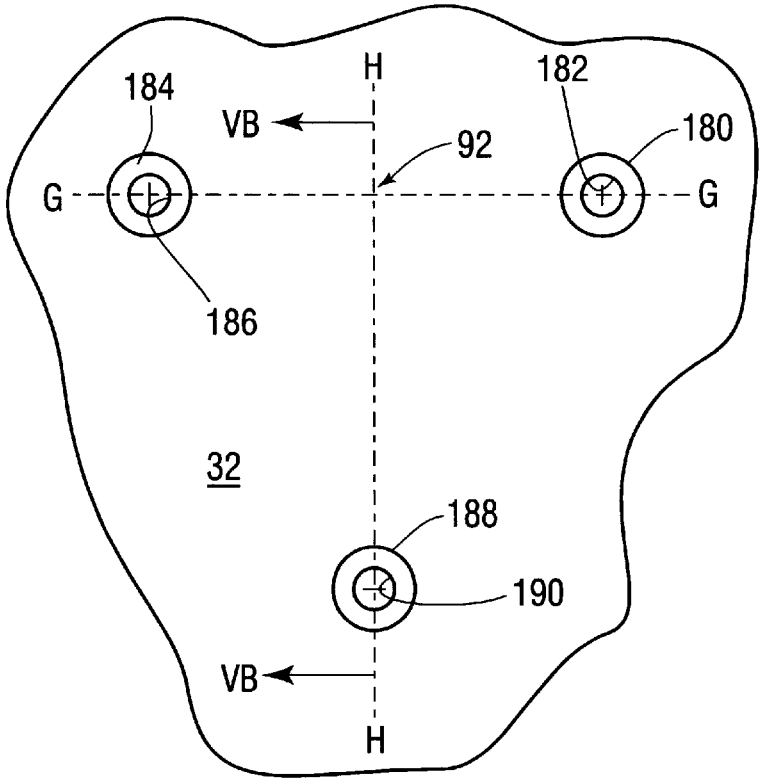
FIG. 4B is a partial view of the rear surface of another antenna illustrating another attachment arrangement of the present invention.
Figure 5B:
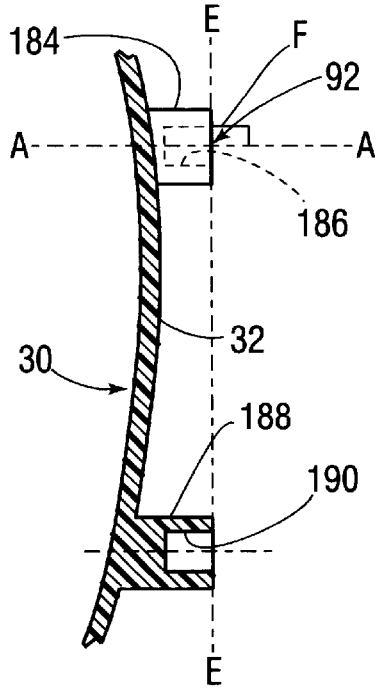
FIG. 5B is a partial cross-sectional view of the antenna of FIG. 4B taken along line VB—VB in FIG. 4B.

In this embodiment, the reflector 30 is molded from reinforced fiberglass plastic utilizing conventional molding techniques. However, reflector 30 may be fabricated from a variety of other suitable materials such as, for example, steel aluminum, etc. The reflector 30 depicted in FIGS. 2 and 3 has a rear portion or surface 32 and a front surface 34. The support arm assembly is affixed to the lower perimeter of the reflector 30 by appropriate fasteners such as screws or like (not shown). As can be seen in FIGS. 4 and 5, the rear surface 32 is provided with a planar attachment portion 80 that is either integrally formed in the rear surface 32 of the reflector 30 (FIGS. 4 and 5) or is otherwise attached thereto by adhesive, welding, screws, etc. (FIGS. 4A and 5A). The planar attachment portion 80 serves to define a plane, represented by line E—E, that is perpendicular or substantially perpendicular to the centerline axis A—A of the reflector (i.e., angle "F" is approximately 90 degrees). As will be appreciated by those of ordinary skill in the art, the plane E—E permits direct measurement of elevation and azimuth with simple devices. In this particular embodiment, the planar attachment portion 80 has a first hole 82, a second hole 84 and a third hole 90 therein. As can be seen in FIG. 4, the centers of holes 82 and 84 are aligned on axis G—G. The purpose of the holes (82, 84, 90) will be discussed in further detail below. In yet another embodiment, three lugs or sockets (180, 184, 188) may be integrally molded or otherwise attached to the rear surface 32 of the reflector 30 by, for example, appropriate adhesive, screws, welding, etc. The three sockets (180, 184, 188) also serve to define a plane E—E that is perpendicular to the antenna's centerline A—A. the first socket 180 has a first hole 182 therein. The second socket 184 has a second hole 186 therein. The third socket 188 has a hole 190 therein. As will become apparent as the present Detailed Description proceeds, the holes (182, 186, 190) serve the same function as the holes (82, 86, 90), respectively. The reader will appreciate that if lugs are employed, the lugs would be similar to the sockets shown in FIGS. 4B and 5B, but would otherwise serve to define a plane E—E that is perpendicular to the centerline A—A of the reflector 30. The lugs could be integrally molded into the rear surface 32 of the reflector 30 or otherwise attached thereto by appropriate adhesive, welding, screws, etc.

FIGS. 6–10 depict an antenna pointing apparatus 100 which can be used in connection with the present invention includes a mounting base 110 and an instrument housing 130 that protrudes from the mounting base 110. Those of ordinary skill in the art will, of course appreciate that other alignment devices could be used in connection with the present invention. The mounting base 110 may be fabricated from plastic or other suitable materials. Housing 130 may be fabricated from plastic or other suitable materials and may have one or more removable panels or portions to permit access to the components housed therein. Housing 130 supports a conventional digital compass 140 that has a digital display 142. Digital compasses are known in the art and, therefore, the manufacture and operation thereof will not be discussed in great detail herein. For example, the digital compass used in a conventional surveying apparatus, including those apparatuses manufactured by Bosch could be successfully employed. As will be discussed in further detail below, when the antenna pointing apparatus 100 is affixed to the antenna reflector 30, the digital compass 140 will display on its display 142 the azimuth setting for the centerline axis A—A of the reflector 30.

Figure 9:
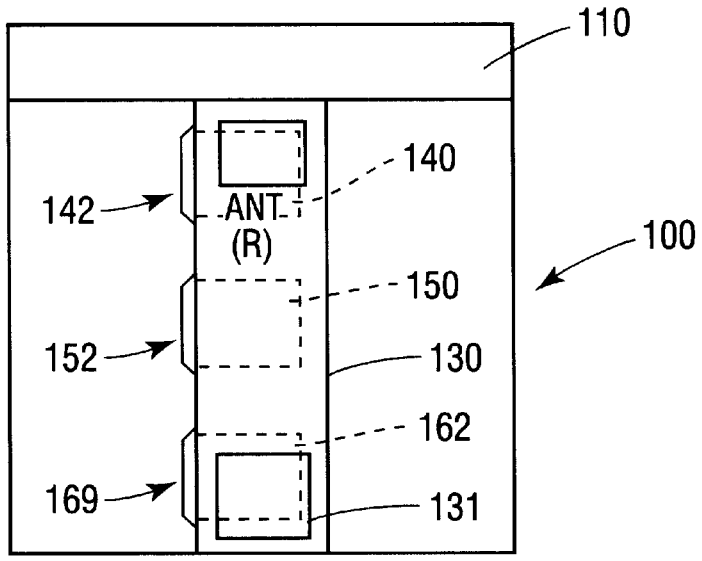
FIG. 9 is a top view of the antenna alignment apparatus of FIGS. 6–8.
Figure 10:
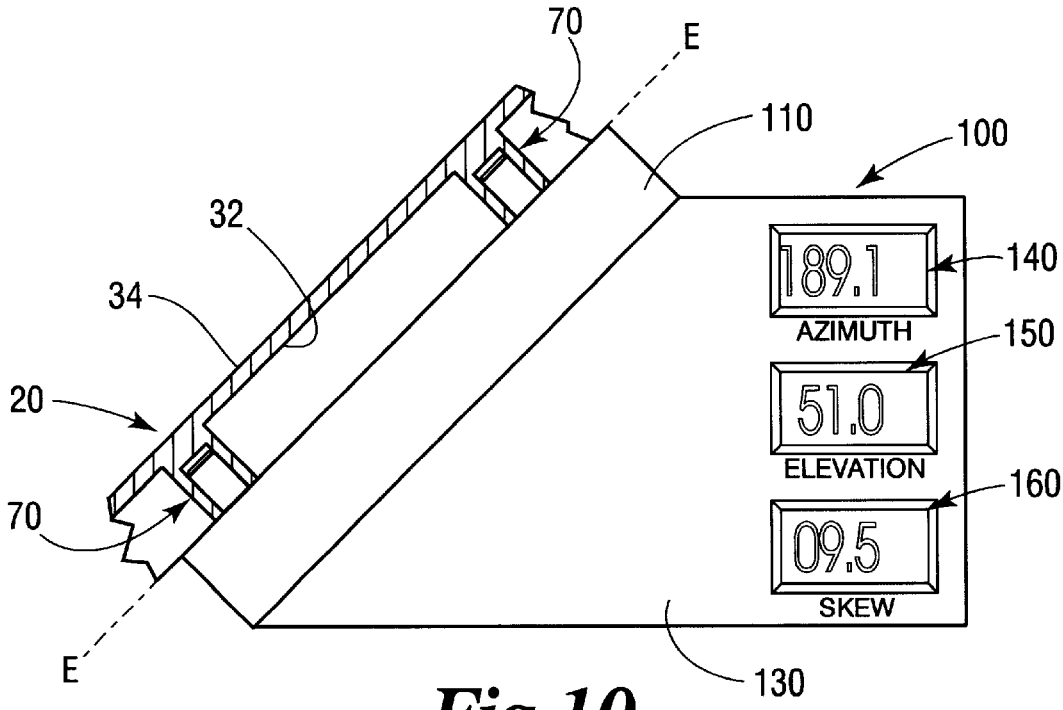
FIG. 10 is a side elevational view of the antenna alignment apparatus of FIGS. 6–9 attached to the rear surface of an antenna reflector with a portion of the antenna reflector shown in cross-section.

Also in this embodiment, a first digital level 150 which has a digital display 152 is supported in the housing member 130 as shown in FIGS. 9 and 10. Such digital levels are known in the art and, therefore, their construction and operation will not be discussed in great detail herein. For example, a digital level of the type commonly employed in surveying apparatuses, including those manufactured by Bosch may be successfully employed. However, other digital levels may be used. Referring back to FIG. 3, the reflector 30 has a major axis A"—A" that extends along the longest dimension of the reflector 30. Major axis A"—A" is perpendicular to the centerline A—A. Similarly, the reflector 30 has a minor axis B"—B" that is perpendicular to major axis A"—A" and is also perpendicular to the centerline A—A. In this embodiment, the centerline of the first digital level 150 is oriented such that it is received in a plane defined by the centerline axis A—A and the minor axis B"—B" when the device 100 is attached to the rear of the reflector 30.

Figure 9A:
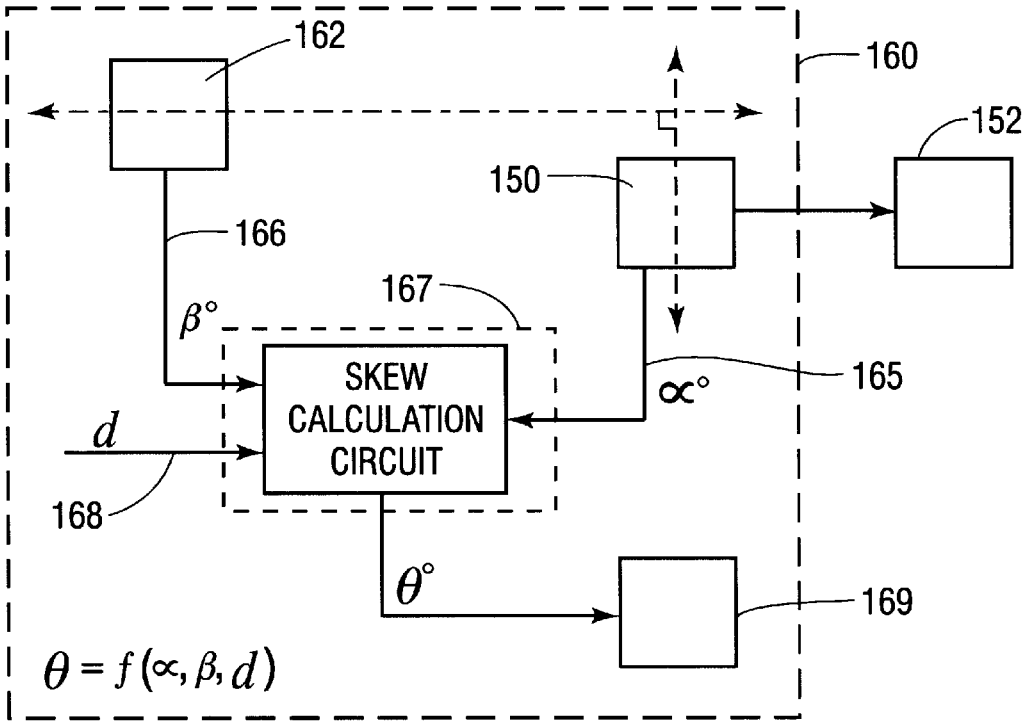
FIG. 9A is a schematic drawing of one control circuit arrangement that may be employed by the antenna alignment apparatus of FIGS. 6–9.

This embodiment of the antenna-pointing device 100 also includes a skew meter generally designated as 160. The skew meter 160 includes a second digital level 162 of the type described above that is mounted perpendicular to the first digital level 152 (i.e., its centerline line will be within the plane defined by the centerline axis A—A and the reflector's major axis A"—A" when the device 100 is attached to the reflector 30). See FIG. 9A. The output of the first digital level 150, which is designated as 165 (defining angle $\alpha$) and the output of the second digital level 162, which is designated as 166 (defining angle $\beta$), are sent to a conventional microprocessor 167. A calibration input, generally designated as 168 and defining distance "d" between a reference point on the device 100 and the centerline A—A of the reflector 30 is also sent to the microprocessor 167. Those of ordinary skill in the art will appreciate that the calibration input permits the installer to calibrate the device 100 for each individual reflector 30. Utilizing standard trigonometry calculations, the microprocessor 167 calculates the skew angle $\theta$ of the reflector 30 and displays it on a digital skew meter display 169.

Figure 6:
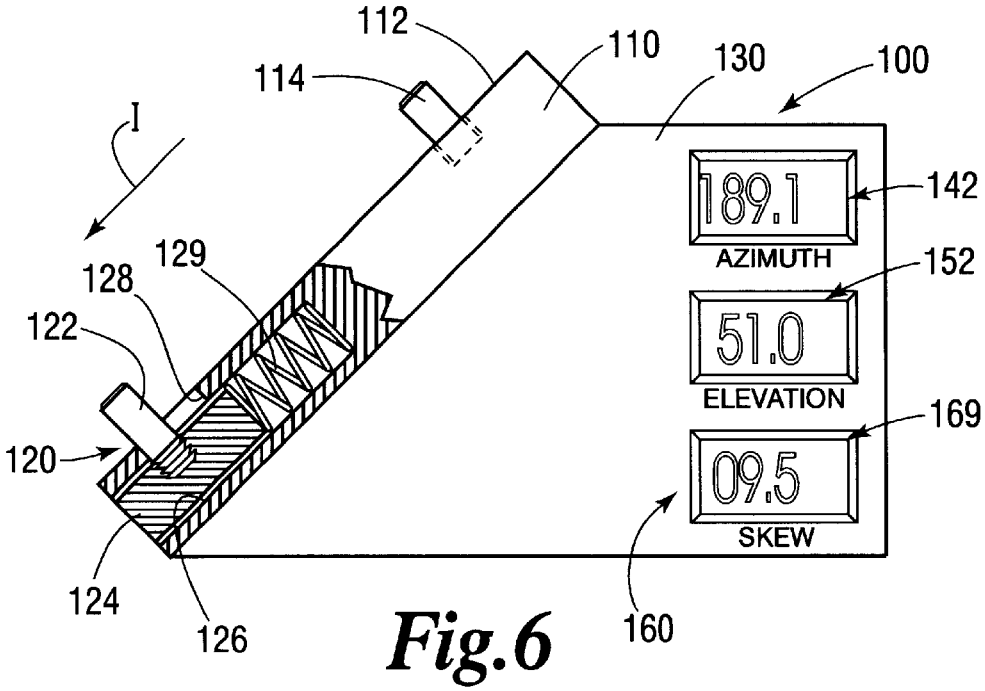
FIG. 6 is a side elevational view of a antenna alignment apparatus that may be used with an alignment configuration of the present invention showing a portion of the mounting member in cross-section.
Figure 7:
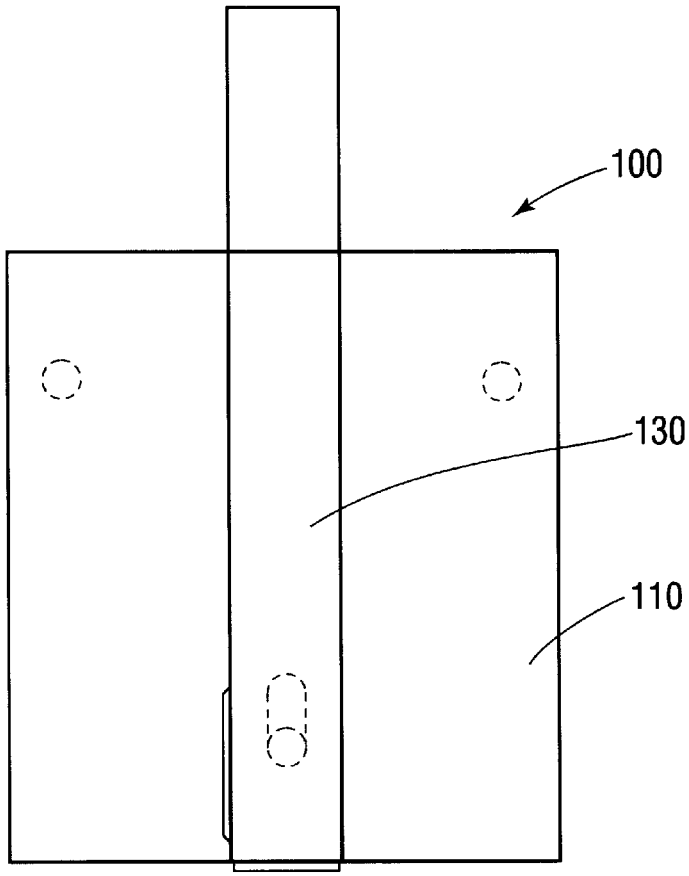
FIG. 7 is a bottom view of the antenna alignment apparatus of FIG. 6.
Figure 8:
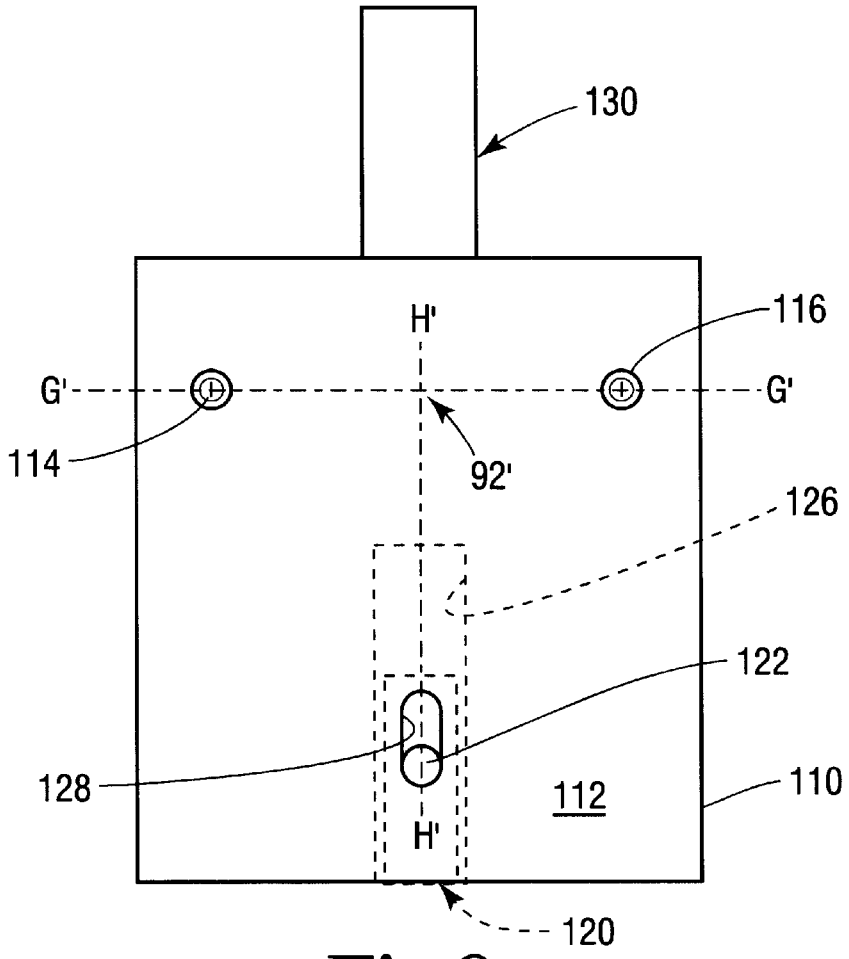
FIG. 8 is a rear view of the antenna alignment apparatus of FIGS. 6 and 7.

The mounting base 100 includes an attachment surface 112 that has a first pin 114 attached thereto that is sized to be inserted into the hole 82 in the first socket 80. A second pin 116 is attached to the mounting base 110 such that it is received in the second hole 86 in the second socket 84 when the first pin 114 is received in the hole 82 in the first socket 80. The centerlines of the first and second pins are located on a common axis G'—G'. See FIG. 8. A third movable pin assembly 120 is also provided in the mounting base 110 as shown in FIGS. 6 and 8. In this embodiment, the movable pin assembly 120 includes a pin 122 that is attached to a movable support member 124 that is slidably received within a hole 126 provided in the mounting base 110. The third pin 122 protrudes through a slot 128 in the mounting base 110 as shown in FIGS. 6 and 8. A biasing member in the form of a compression spring 129 is provided in the hole 126 and serves to bias the third pin 122 in the direction represented by arrow "I". The centerline H'—H' of the third movable pin 122 is perpendicular to and intersects axis G'13 G' at point 92' as shown in FIG. 8.

To attach the mounting base 110 to the antenna reflector 30, the installer inserts the third pin 122 into the third hole 90 and applies a biasing force to the pointing device 100 until the first pin 114 may be inserted into the first hole 82 in first socket 80 and the second pin 116 may be inserted into the second hole 86 in the second socket 84. When pins (114, 116, and 122) have been inserted into their respective holes (82, 86, 90), the spring 129 applies a biasing force against the support member 110 that, in turn, biases the third pin 122 into frictional engagement with the inner surface of the third hole 90 in the third socket 88 to removably affix the pointing device 100 to the antenna reflector 30. When affixed to the antenna reflector 30 in that manner (see FIG. 10), the distance "d" between the point 92' (see FIG. 8) and the point 92 (see FIG. 4B) through which centerline axis A—A of the antenna reflector 30 extends is input into the microprocessor 167 by a keypad or other standard input device to enable the microprocessor 167 to calculate and display the skew angle $\theta$ on the digital skew meter display 169. See FIG. 9A. In this embodiment, the digital compass 142 and the first and second digital levels 152 and 162, respectively are powered by a battery (not shown) supported in the housing 130. The battery may be rechargeable or comprise a replaceable battery or batteries. The housing 130 is provided with a battery access door 131 to permit the installation and replacement of batteries. However, it is conceivable that other compasses and digital levels that require alternating current may be employed.

The antenna-pointing device 100 may be employed to align the antenna's centerline axis A—A with the satellite as follows. After the antenna-mounting bracket 12 has been installed, the antenna 20 is affixed to the mounting bracket 12. In this embodiment, the mast portion 14 of the mounting bracket 12 is inserted into the socket 46 in the rear-mounting portion 44 of the arm assembly 40. The mast 14 is retained within the socket 46 by means of one or more setscrews 47 that extend through the rear-mounting portion 44 to engage the mast 14. See FIGS. 2 and 3. After the antenna has been preliminarily mounted to the mounting bracket 12, the antenna-pointing device 100 is snapped onto the rear of the antenna reflector 30 in the above-described manner. Because the antenna-pointing device 100 is affixed to the rear of the reflector 30, the installer's hands are free to adjust the antenna until it has been set at a desired azimuth, elevation and skew.

Upon attachment to the reflector, the azimuth display 142 will display the azimuth reading for the antenna's initial position. The installer then adjusts the antenna's position until the digital compass displays the desired azimuth reading. The antenna 20 is then locked in that position. The installer then observes the elevation reading displayed on the elevation display 152 by the first digital level 150 and adjusts the position of the antenna until the elevation meter displays the desired reading and the antenna 20 is locked in that position. The setscrews 47 are loosened to permit the antenna to be rotated about the mast 14. The user then observes the skew meter display 169 and rotates the rearwardly extending portion 44 of the support arm 40 about the mast 14 until the skew meter 169 display displays the desired setting. Thereafter, the setscrews 47 are screwed into contact the support mast 14 to retain the antenna 20 in that position. The skilled artisan will appreciate that, because the centerline axis A—A is coaxially aligned with the centerline of the socket 46 in the support arm 40, the antenna 20 can be moved to the desired skew orientation by simply rotating the antenna reflector 30 about the mast 14. It will be further understood that the antenna pointing device 100 may also be used with other antennas that are mounted utilizing conventional mounting brackets and support apparatuses. The order of antenna adjustments described herein is illustrative only. Those of ordinary skill in the art will appreciate that the installer could, for example, set the skew first or the elevation first when orienting the antenna 20.

If the installer wishes to employ a set top box 60 to further optimize the antenna's alignment with the satellite 14, a coaxial cable 62 is attached to the feed/LNBF assembly 45 and the set top box 60. The antenna's position is further adjusted while monitoring the graphical display on the television 48 and the audio signal emitted by the set top box.

Thus, from the foregoing discussion, it is apparent that the present invention solves many of the problems encountered by prior antenna alignment devices and methods. In particular, present invention provides a plane at the rear of an antenna reflector that is perpendicular to the antenna's boresite such that simple devices may be used to accurately orient the reflector in a desired elevation azimuth and skew orientation. It will be appreciated that other compasses and levels other than the alignment device disclosed herein may be readily employed to orient an antenna in a desired orientation. The present invention enables one installer to quickly and efficiently install and align an antenna with a satellite. Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. A method for aligning an antenna reflector having a centerline and front and rear surfaces with a satellite, said method comprising:

attaching a reflector support member to a portion of the antenna reflector;

supporting the reflector support member to orient the antenna reflector in a first orientation;

establishing a reference plane on the antenna reflector apart from the portion of the antenna reflector to which the reflector support member is attached, said reference plane being perpendicular to the centerline of the reflector; and orienting a compass such that it is perpendicular with respect to the centerline.

2. The method of claim 1 wherein the antenna reflector has a perimeter and wherein said attaching a reflector support member to a portion of the antenna reflector comprises attaching a support arm to the perimeter of the antenna reflector.

3. The method of claim 2 further comprising attaching the support arm to a mounting bracket.

4. The method of claim 3 wherein said attaching the support arm to a mounting bracket comprises:

coupling a mast to one end of the support arm; and coupling the mast to the mounting bracket.

5. The method of claim 3 wherein the support arm has a protrusion extending therefrom and wherein said attaching the support arm to the mounting bracket comprises attaching the protrusion to the mounting bracket.

6. The method of claim 1 further comprising:

moving the antenna reflector support member to a desired azimuth position wherein a desired azimuth angle is displayed on the compass; and retaining the antenna reflector in the desired azimuth position.

7. A method for aligning an antenna reflector having a centerline and front and rear surfaces with a satellite, said method comprising:

attaching a reflector support member to a portion of the antenna reflector;

establishing a reference plane on the antenna reflector apart from the portion of the antenna reflector to which the reflector support member is attached, said reference plane being perpendicular to the centerline of the reflector; and orienting a level such that it is parallel with respect to the centerline.

8. The method of claim 7 wherein the antenna reflector has a perimeter and wherein said attaching a reflector support member to a portion of the antenna reflector comprises attaching a support arm to the perimeter of the antenna reflector.

9. The method of claim 8 further comprising attaching the support arm to a mounting bracket.

10. The method of claim 9 wherein said attaching the support arm to a mounting bracket comprises:

coupling a mast to one end of the support arm; and coupling the mast to the mounting bracket.

11. The method of claim 9 wherein the support arm has a protrusion extending therefrom and wherein said attaching the support arm to the mounting bracket comprises attaching the protrusion to the mounting bracket.

12. The method of claim 7 further comprising:

moving the antenna reflector support member to a desired elevation position wherein a desired elevation reading is displayed on the level; and retaining the antenna reflector in the desired elevation position.

13. A method for aligning an antenna reflector having a centerline and front and rear surfaces with a satellite, said method comprising:

attaching a reflector support member to a portion of the antenna reflector;

establishing a reference plane on the antenna apart from the portion of the antenna reflector to which the reflector support member is attached, said reference plane being perpendicular to the centerline;

orienting a compass such that it is perpendicular with respect to the centerline;

viewing the compass to ascertain the azimuth of the antenna;

reorienting the antenna reflector to a desired azimuth position;

retaining the antenna reflector in the desired azimuth position;

orienting a level such that it is parallel with respect to the centerline;

viewing the level to ascertain the elevation of the antenna reflector;

reorienting the antenna reflector to a desired elevation position; and retaining the antenna reflector in the desired elevation position.

14. The method of claim 13 wherein the antenna reflector has a perimeter and wherein said attaching a reflector support member to a portion of the antenna reflector comprises attaching a support arm to the perimeter of the antenna reflector.

15. The method of claim 14 further comprising attaching the support arm to a mounting bracket.

16. The method of claim 15 wherein said attaching the support arm to a mounting bracket comprises:

coupling a mast to one end of the support arm; and coupling the mast to the mounting bracket.

17. The method of claim 14 wherein the support arm has a protrusion extending therefrom and wherein said attaching the support arm to the mounting bracket comprises attaching the protrusion to the mounting bracket.

18. An antenna, comprising:

an antenna reflector having a centerline and a front surface, a rear surface and a perimeter, wherein a portion of said rear surface defines a reference plane that is substantially perpendicular to said centerline; and a support arm assembly attached to a portion of said reflector apart from said portion of said rear surface defining said reference plane, said support arm assembly having a forwardly extending portion that extends beyond said front surface of said antenna reflector and a rearwardly extending portion that extends beyond said rear surface of said antenna reflector for supporting said antenna reflector in a desired orientation.

19. The antenna of claim 18 wherein said forwardly extending portion of said support arm supports a feed/LNBF assembly and wherein said rearwardly extending portion is coupled to a mounting mast.

20. The antenna of claim 19 wherein said rearwardly extending portion has a socket therein for receiving a portion of said mounting mast therein.

21. The antenna of claim 20 wherein another portion of said mounting mast is received in an adjustable mounting bracket.

22. The antenna of claim 18 wherein said forwardly extending portion of said support arm supports a feed/LNBF assembly and wherein said rearwardly extending portion has a protrusion formed thereon that is sized to be supported in a mounting bracket.

23. The antenna of claim 22 wherein said protrusion is received within a socket in said mounting bracket.

24. An antenna comprising:

an antenna reflector having a centerline, a front surface, a rear surface and a perimeter;

a reflector support arm assembly attached to a portion of said perimeter of said antenna reflector and having a forwardly extending portion that extends beyond said front surface of said antenna reflector and a rearwardly extending portion that extends beyond said rear surface of said antenna reflector for supporting said antenna reflector in a desired orientation; and three sockets molded to said rear surface of said antenna reflector apart from said portion of said perimeter of said antenna reflector to which said reflector support arm assembly is attached, said sockets defining a reference plane that is perpendicular to said centerline.

25. The antenna of claim 24 wherein said forwardly extending portion of said support arm supports a feed/LNBF assembly and wherein said rearwardly extending portion is coupled to a mounting mast.

26. The antenna of claim 25 wherein said rearwardly extending portion has a socket therein for receiving a portion of said mounting mast therein.

27. The antenna of claim 25 wherein another portion of said mounting mast is received in an adjustable mounting bracket.

28. The antenna of claim 24 wherein said forwardly extending portion of said support arm supports a feed/LNBF assembly and wherein said rearwardly extending portion has a protrusion formed thereon that is sized to be supported in a mounting bracket.

29. The antenna of claim 28 wherein said protrusion is received within a socket in said mounting bracket.

30. An antenna comprising:

an antenna reflector having a centerline, a front surface, a rear surface, and a perimeter;

a reflector support arm assembly attached to a portion of said perimeter of said antenna reflector, said support arm assembly having a forwardly extending portion that extends beyond said front surface of said antenna reflector and a rearwardly extending portion that extends beyond said rear surface of said antenna reflector for supporting said antenna reflector in a desired orientation; and three sockets glued to said rear surface of said antenna reflector apart from said portion of said reflector to which said reflector support member is attached, said sockets defining a reference plane that is perpendicular to said centerline.

31. The antenna of claim 30 wherein said forwardly extending portion of said support arm supports a feed/LNBF assembly and wherein said rearwardly extending portion is coupled to a mounting mast.

32. The antenna of claim 31 wherein said rearwardly extending portion has a socket therein for receiving a portion of said mounting mast therein.

33. The antenna of claim 31 wherein another portion of said mounting mast is received in an adjustable mounting bracket.

34. The antenna of claim 30 wherein said forwardly extending portion of said support arm supports a feed/LNBF assembly and wherein said rearwardly extending portion has a protrusion formed thereon that is sized to be supported in a mounting bracket.

35. The antenna of claim 34 wherein said protrusion is received within a socket in said mounting bracket.

36. An antenna comprising:

an antenna reflector having a centerline, a front surface, a rear surface, and a perimeter;

a reflector support arm assembly attached to a portion of said perimeter of said antenna reflector and having a forwardly extending portion that extends beyond said front surface of said antenna reflector and a rearwardly extending portion that extends beyond said rear surface of said antenna reflector for supporting said antenna reflector in a desired orientation; and a planar attachment portion attached to said rear surface apart from said portion of said perimeter of said antenna reflector to which said reflector support arm assembly is attached and defining a plane that is perpendicular to the centerline.

37. The antenna of claim 36 wherein said forwardly extending portion of said support arm supports a feed/LNBF assembly and wherein said rearwardly extending portion is coupled to a mounting mast.

38. The antenna of claim 37 wherein said rearwardly extending portion has a socket therein for receiving a portion of said mounting mast therein.

39. The antenna of claim 37 wherein another portion of said mounting mast is received in an adjustable mounting bracket.

40. The antenna of claim 36 wherein said forwardly extending portion of said support arm supports a feed/LNBF assembly and wherein said rearwardly extending portion has a protrusion formed thereon that is sized to be supported in a mounting bracket.

41. The antenna of claim 40 wherein said protrusion is received within a socket in said mounting bracket.

42. An antenna, comprising:

an antenna reflector having a centerline and a front surface and a rear surface, said rear surface having at least three lugs integrally attached thereto and defining a reference plane that is substantially perpendicular to said centerline and wherein at least two of said lugs each have a socket formed therein, said at least two sockets being aligned on a common axis such that said centerline of said antenna reflector perpendicularly intersects said common axis; and a reflector support member attached to another portion of said reflector apart from said lugs and supporting said antenna reflector in a desired orientation.

43. An antenna comprising:

an antenna reflector having a centerline and front and rear surfaces;

a reflector support member attached to a portion of said antenna reflector for supporting said reflector in a desired orientation; and three sockets molded to said rear surface of said antenna reflector apart from said portion of said antenna reflector to which said reflector support member is attached, said sockets defining a reference plane that is perpendicular to said centerline, and wherein at least two of said sockets are aligned on a common axis such that said centerline of said antenna reflector perpendicularly intersects said common axis.

44. An antenna comprising:

an antenna reflector having a centerline and front and rear surfaces;

a reflector support member attached to a portion of said antenna reflector in a desired orientation; and three sockets glued to said rear surface of said antenna reflector apart from said portion of said reflector to which said reflector support member is attached, said sockets defining a reference plane that is perpendicular to said centerline, and wherein at least two of said sockets are aligned on a common axis such that said centerline of said antenna reflector perpendicularly intersects said common axis.

* * * * *